United States Patent [19]

Ono et al.

[11] Patent Number: 4,519,337

[45] Date of Patent: May 28, 1985

[54] APPARATUS FOR CONTINUOUS HOT DIPPING OF METAL STRIP

[75] Inventors: Yoshio Ono; Takashi Tanaka, both of Osaka, Japan

[73] Assignee: Nisshin Steel Co., Ltd., Tokyo, Japan

[21] Appl. No.: 301,805

[22] Filed: Sep. 14, 1981

Related U.S. Application Data

[63] Continuation of Ser. No. 97,550, Nov. 26, 1979, abandoned.

[51] Int. Cl.[3] ..... B05C 3/152; B05C 11/00; B05C 11/06

[52] U.S. Cl. ..... 118/33; 118/63; 118/67; 118/69; 118/419; 118/424; 277/3; 432/236; 432/244

[58] Field of Search ..... 118/33, 50, 50.1, 63, 118/67, 69, 419, 424; 427/349, 172, 321; 277/3; 432/244, 236; 34/242

[56] References Cited

U.S. PATENT DOCUMENTS

| | | | |
|---|---|---|---|
| 2,797,173 | 6/1957 | Keller | 427/321 X |
| 3,082,009 | 3/1963 | Whitley et al. | 277/3 X |
| 4,059,711 | 11/1977 | Mino et al. | 427/349 X |
| 4,167,150 | 9/1979 | Davis et al. | 118/33 |
| 4,189,157 | 2/1980 | Mahan et al. | 277/3 |
| 4,285,668 | 8/1981 | Pepe | 432/19 |

FOREIGN PATENT DOCUMENTS

| | | | |
|---|---|---|---|
| 2010989A | 7/1979 | United Kingdom | 277/3 |

*Primary Examiner*—Evan K. Lawrence

*Attorney, Agent, or Firm*—Wenderoth, Lind & Ponack

[57] ABSTRACT

In continuous hot dipping of metal strip, the tension of the strip at pre-treatment furnaces and that at air-wiping nozzles are isolated and made independent of each other. For this purpose bridle rolls driven by motors are disposed downstream of the pre-treatment furnaces. The tension at the former is maintained at a lower value, while the tension at the latter is maintained at a higher value. The bridle rolls are mounted in bearings which are covered by seal boxes in which an inert gas is enclosed so as to prevent the intrusion of atmospheric air into the furnaces.

1 Claim, 7 Drawing Figures

APPARATUS FOR CONTINUOUS HOT DIPPING OF METAL STRIP

This application is a continuation of Ser. No. 97,550 filed Nov. 26, 1979, abandoned.

BACKGROUND OF THE INVENTION

This invention relates to an apparatus for continuous hot dipping of metal strip.

In a continuous process for hot dipping metal strip, the amount of the molten metal which adheres to the strip is generally controlled by nozzles using an inert gas. This control is effected by regulating the pressure of the inert gas and the gap between the nozzles and the strip. When thin plating is desired, the pressure is set at a higher level and the gap is made smaller, and on the other hand, when thick plating is necessary, the pressure is set at a lower level and the gap is made smaller. In such a method for regulating the thickness of the plating, the problem of how to minimize the amplitude of the vibration of the strip at the nozzles is very important. If the amplitude of the vibration of the strip is considerable, the thickness becomes uneven, and in an extreme case the strip may come into contact with the nozzles causing them to clog. In particular, this problem is severe when thin plating is desired, since the gap between the nozzles is smaller in this situation. On the other hand, recent plating arrangements have become bigger and the line speed of the strip has become faster with speeds up to 200 to 250 m/min being used. The amplitude of the vibration of the strip generally increases in proportion to the line speed. Accordingly the necessity to reduce the vibration of the strip has become even greater.

One known method for reducing the vibration of the strip is to raise the tension of the strip at the nozzles, for example, to a level of 0.5 to 6.0 kg/mm$^2$. However it has not been possible to adapt this method for the usual plating arrangement. The reason is as follows. Because the tension of the strip at the nozzles is regulated by a tension controller and tension bridle rolls which are disposed at the respective upstream and downstream ends of the overall apparatus, when the tension is raised to increase the tension at the nozzles to a high value, the tension at pre-treatment furnaces is also raised to the same value. In the pre-treatment furnaces, the strip is heated to a high temperature, and in some furnaces the temperature reaches a temperature of 760° to 800° C. which exceeds the $A_1$ transformation point. Accordingly if the tension of the strip is raised to too high a value, the strip may be cut or shrunk widthwise. Therefore a tension of no higher than 0.3 to 0.6 kg/mm$^2$ is generally recognized to be acceptable. For the above described reason, the tension of the strip at the nozzles, in such an apparatus must also be in the above range i.e. 0.3 to 0.6 kg/mm$^2$. Therefore a certain degree of vibration in the strip can not be prevented, and the line speed of the strip can not be raised to a desired speed.

SUMMARY OF THE INVENTION

It is an object of the invention to provide an apparatus for continuous hot dipping of the metal strip, which can overcome the problem of the inability to increase the tension of the strip at the nozzles to the desired value, and by which the vibration of the strip is substantially prevented.

It is another object of the invention to further reduce the vibration of the strip by providing additional support rolls.

It is also one further object of the invention to avoid causing other defects by raising the tension of the strip.

According to the present invention, the respective tensions of the strip at the pre-treatment furnaces and at the nozzles are isolated from each other by bridle rolls disposed downstream of the pre-treatment furnaces. Tension at the former and latter points can be controlled independently, and the tension at the former is preferably 0.3 to 0.6 kg/mm$^2$ and at the latter is preferably 0.5 to 6.0 kg/mm$^2$.

The bridle rolls are mounted in bearings which are covered by seal boxes in which an inert gas is enclosed so as to prevent the intrusion of atmospheric air into the furnaces.

In another embodiment of the invention, two support rolls are further disposed just upstream of the nozzles with the height of the center shafts thereof offset in relation to each other.

BRIEF DESCRIPTION OF THE DRAWINGS

The above brief description, as well as further objects, features and advantages of the present invention, will be more fully understood by reference to the following detailed description of the presently preferred, but nonetheless illustrative, embodiment in accordance with the present invention when taken in conjunction with the accompanying drawings, wherein.

DESCRIPTION OF THE PREFERRED EMBODIMENT

Figure 1:
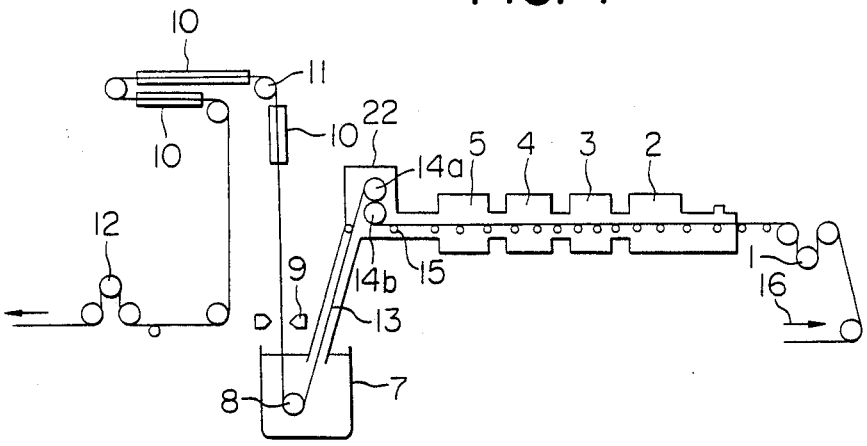
FIG. 1 is a schematic illustration of the apparatus for continuous hot dipping of metal strip according to the invention.

Referring now to FIG. 1 of the drawings, there is shown an apparatus for the continuous hot dipping of metal strip, which comprises a tension controller 1, a nonoxidizing preheating furnace 2, an equalizing heating furnace 3, a jet-type cooling furnace 4, an adjusting cooling furnace 5, bridle rolls 14*a* and 14*b*, a dipping bath 7 having a turning roll 8, air-wiping nozzles 9, cooling apparatuses 10, a deflector roll 11, and tension bridle rolls 12.

In the prior technology, there is provided only a turning roll instead of the bridle rolls 14*a* and 14*b* of the present apparatus. The construction of the bridle rolls 14*a* and 14*b* is shown in FIG. 2.

Figure 2:
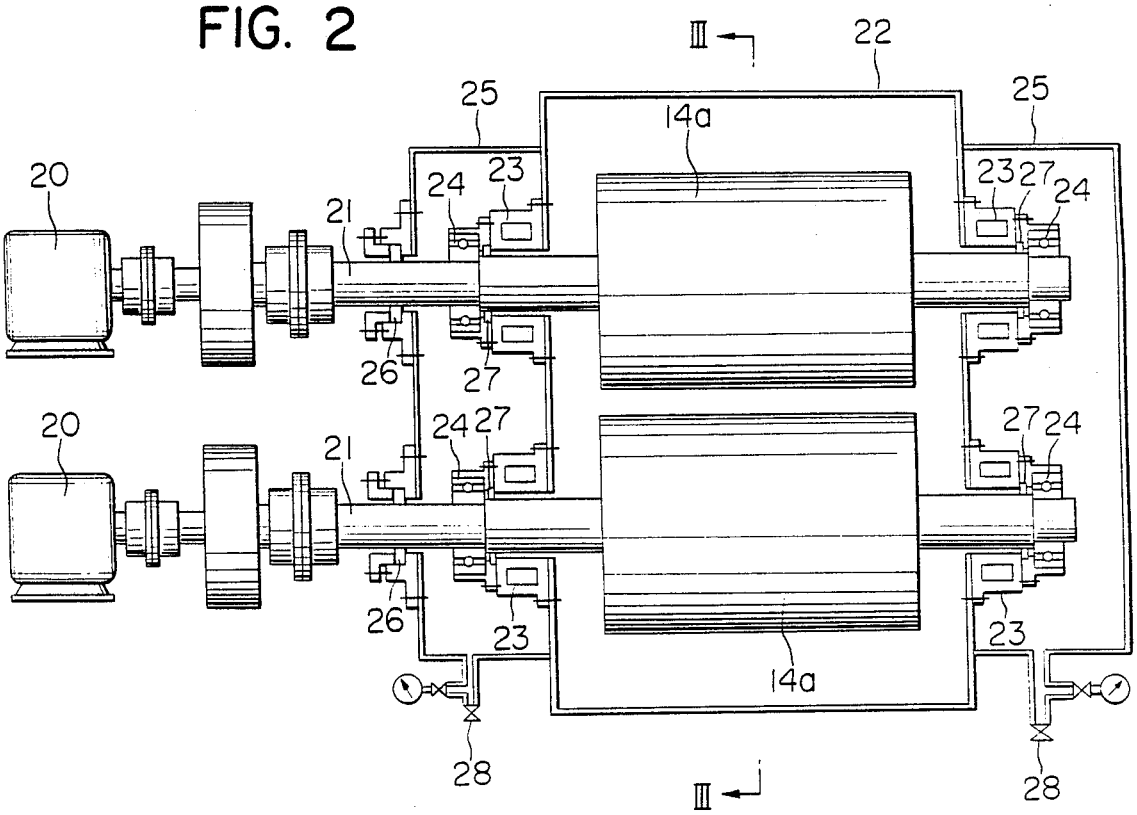
FIG. 2 is an enlarged sectional side view of the bridle rolls shown in FIG. 1.

Referring to FIG. 2, each bridle roll is driven by a motor 20 through a drive shaft 21. Both rolls 14*a* and 14*b* are housed in a furnace 22 which has water jackets 23 mounted on its sides, and on each water jacket 23 there is provided a bearing 24 for rotatably mounting the rolls 14*a* and 14*b*. The bearings 24 on each side of the furnace 22 are covered by a sealing box 25. The sealing box 25 on the side on which the motors 20 are disposed has sealing members 26 for sealing the openings through which the drive shafts 21 extend. Another sealing member 27 is disposed between each bearing 24 and the corresponding water jacket 23. Each sealing box 25 has a gas inlet 28, through which an inert gas such as nitrogen is fed to maintain a constant pressure inside the box. By the above described construction, inert gas chambers are formed between the furnace 22 and the atmosphere. Accordingly the sealing is improved in comparison with the usual sealing device using only one sealing member, so that intrusion of the outer air into the furnace 22 is substantially prevented.

Figure 3:
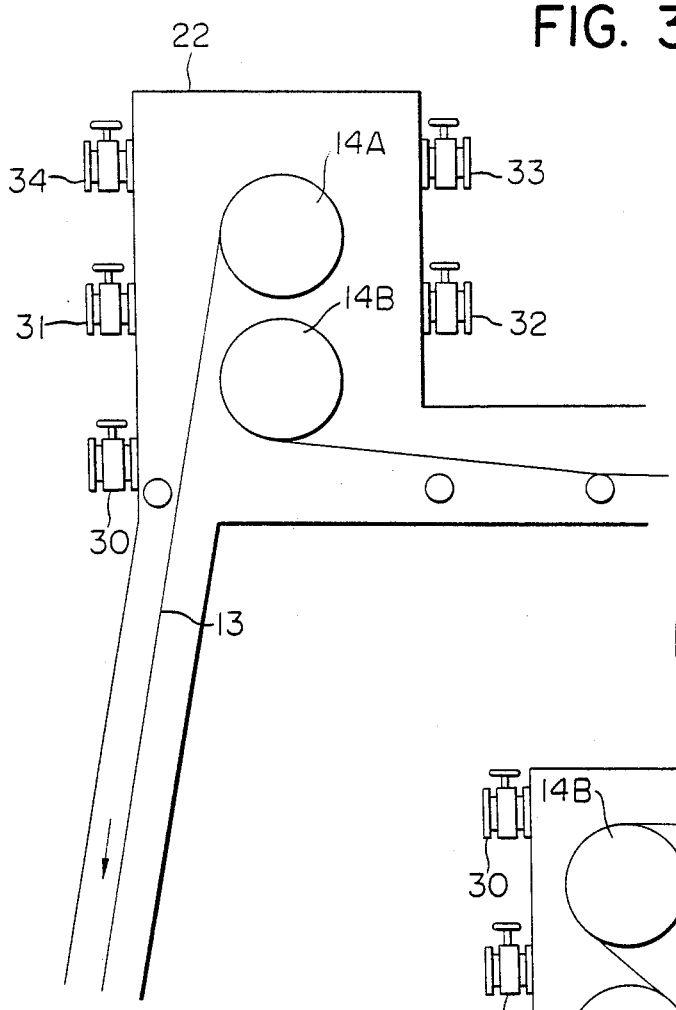
FIG. 3 is a schematic sectional view taken along the lines III—III of FIG. 2.

Referring to FIG. 3, the metal strip 13 passes through the bridle rolls as shown in the drawing. Gate valves 30, 31, 32, 33 and 34 are used for initially threading the strip 13 between the rolls.

Figure 4:
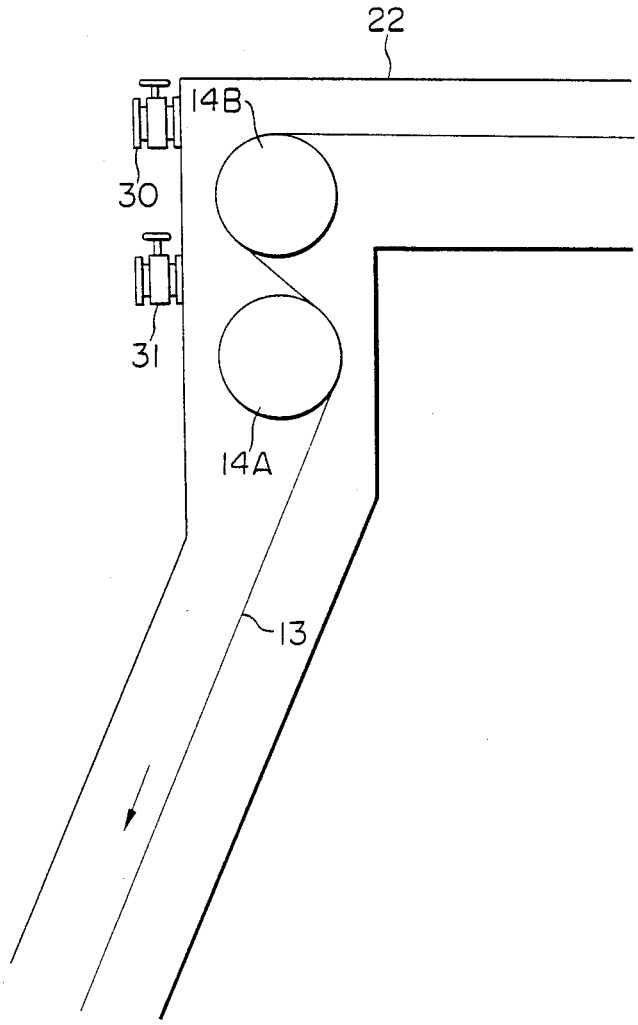
FIGS. 4 and 5 are views similar to FIG. 3 showing other embodiments of the bridle rolls respectively.
Figure 5:
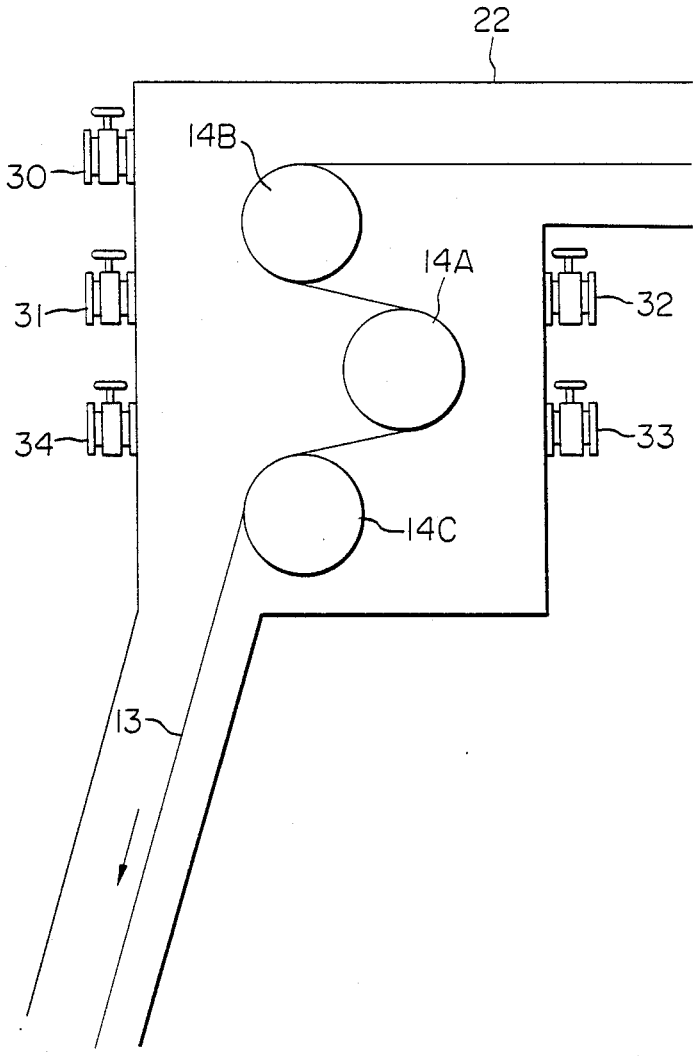

However, the bridle rolls can be arranged as shown in FIGS. 4 and 5.

In operation, the strip 13 runs in the direction shown by the arrow 16 in FIG. 1, and first passes the preheating furnace 2, in which oil and dust on the surface of the strip 13 are lifted off in vapor or removed by chemical reactions by means of high temperature incomplete combustion gas at a temperature of 1100° to 1300° C. Then, in the equalizing furnace 3, the strip 13, which has been slightly oxidized, is deoxidized in a deoxidizing atmosphere such as hydrogen at 900° to 1000° C., and then the strip 13 is cooled in the cooling furnace 4, and in the furnace 5 the strip 13 is maintained in a deoxidizing atmosphere and subjected to an overaging treatment. Then, the strip 13 passes the bridle rolls 14*a* and 14*b* driven by the motors 20, and is led into the dipping bath 7 to cause the molten metal to adhere to its surfaces. The strip 13 is then taken out, and the amount of the adhered molten metal on the strip is regulated by the nozzles 9, and finally it is cooled by the cooling apparatuses 10.

The most important feature of the present invention is the provision of the bridle rolls. The connection between the tension of the strip 13 in the pre-treatment furnaces and that at the nozzles 9 is broken by the bridle rolls. That is to say, the tension at the former location is established by the relation between the output of the tension controller 1 and that of the motors 20 which drive the bridle rolls, while the tension in the latter location is established by the relation between the output of the motors 20 and that of the tension bridle rolls 12.

Accordingly the former and latter tensions can be regulated independently of each other, that is, the tension at the former location is set at a low value while that at the latter location is set at a higher value. As a result, the tension at the latter location can be raised so as to prevent the vibration of the strip at the nozzles without fear of damaging the strip in the pre-treatment furnaces. Thus the amplitude of the vibration of the strip is reduced sharply, for example, to a level one fourth the usual level. Therefore the line speed of the strip can be raised even when thin plating is desired.

Figure 6:
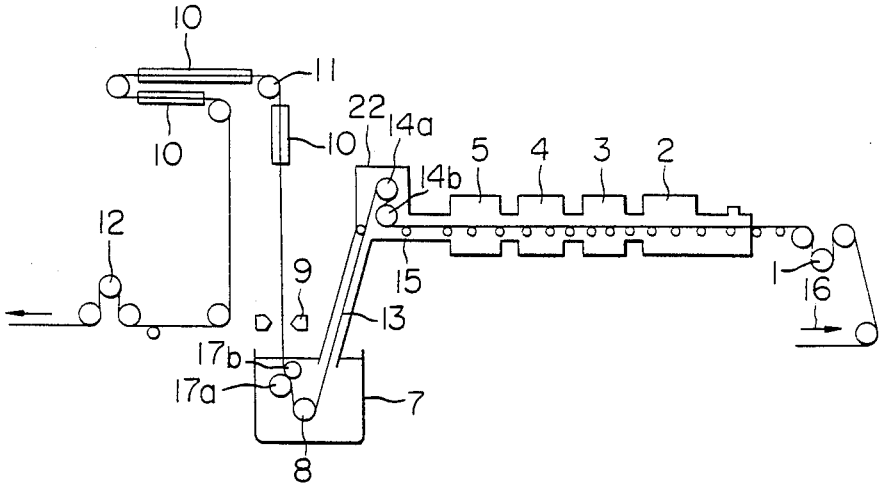
FIG. 6 is a schematic illustration of an another embodiment of the present invention.

FIG. 6 shows another embodiment of the invention. In this embodiment, two support rollers (one larger roller 17*a* and another smaller roller 17*b*) are disposed in the neighborhood of the outlet of the dipping bath 7 at different heights and with the the center shafts thereof laterally offset in relation to each other, so that the path of travel of the strip 13 is offset by a small distance. By using this arrangement of the support rolls 17*a* and 17*b*, the strip 13 is supported more rigidly so that the amplitude of the vibration of the strip is reduced even further. This arrangement is particularly effective for a thin strip.

Figure 7:
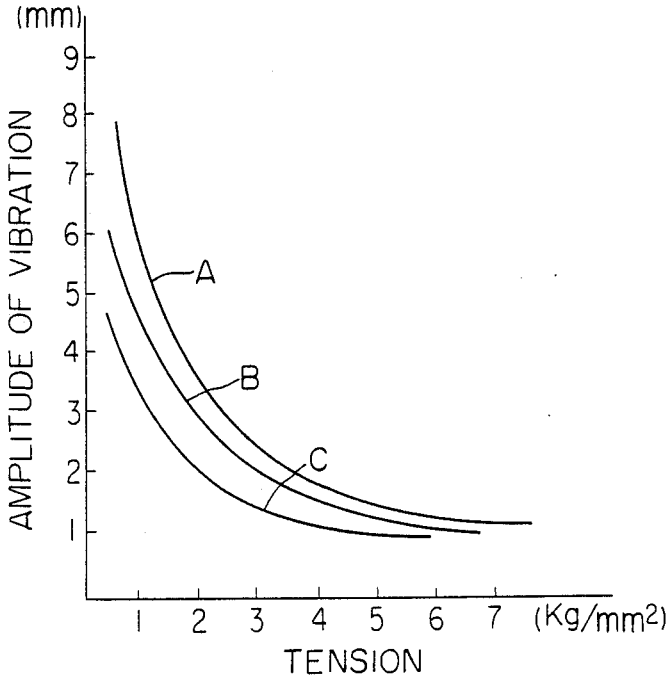
FIG. 7 is a diagram showing the relation between tension and amplitude of vibration.

To show the effects of the invention, the results of experiments are shown in FIG. 7. In the experiments, the tension of the strip at the nozzles was varied and the amplitude of the vibrations of the strip determined.

(1) EXAMPLE 1

Thickness of the metal strip: 0.35 mm
Width of the metal strip: 1000 mm
Line speed: 150 m/min.
Support rolls: not used
Molten metal: zinc The variation of the amplitude of the vibration of the strip in relation to the tension of the strip is shown in curved line A.

(2) EXAMPLE 2

Thickness of the metal strip: 1.6 mm
Width of the metal strip: 1000 mm
Line speed: 70 m/min.
Support rolls: not used
Molten metal: zinc The relation of the tension to the amplitude of vibration is shown by curved line B.

(3) EXAMPLE 3

Thickness of the metal strip: 0.35 mm
Width of the metal strip: 1000 mm
Line speed: 150 m/min.
(The above conditions are the same as in example 1)
Support rolls: used
Molten metal: zinc The relation of the tension to the amplitude of vibration is shown by curved line C.

It is easily understood from curved lines A, B and C in FIG. 7 that the amplitude of the vibration of the strip is significantly reduced by raising the tension of the strip at the nozzles. However, even if the tension is raised above a value of 6 kg/mm$^2$, the effect is not further increased. Accordingly it is to be understood that a tension above 6 kg/mm$^2$ is meaningless as far as reducing the vibration is concerned. By comparing line C with line A, the effect of the provision of the support rolls can be clearly understood.

As a result of being able to reduce the vibration of the strip, the variation of the plating thickness in the longitudinal direction, of the strip is minimized and poor wiping in a high speed thin plating operation is prevented. Further, in a high speed thin plating operation, the gap between the nozzles can be reduced so that the nozzle jet pressure is reduced, thereby minimizing the splash of the molten metal. Because the tension of the strip in the pre-treatment furnaces can be maintained at a low level, breakage of the strip in the furnaces is avoided and the width of the strip can be kept precise.

It is to be understood that this invention can be applied to hot dipping of any kind of molten metal including aluminum, zinc etc.

As will be readily apparent to those skilled in the art, the present invention may be realized in other specific forms without departing from its spirit or essential characteristics. The present embodiment is, therefore, to be considered as illustrative and not restrictive, the scope of the invention being indicated by the claims rather than by the foregoing description, and all changes which come within the meaning and range of equivalents of the claims are therefore intended to be embraced therein.

What is claimed is:

1. An apparatus for continuous hot dipping of metal strip comprising:

pre-treatment furnaces;

a dipping bath downstream of said pre-treatment furnaces;

air wiping nozzles adjacent the exit from said dipping bath for regulating the amount of molten metal adhering to a strip being dipped;

means for passing metal strip through said pre-treatment furnaces and dipping bath and past said nozzles, said means including tension roll means at the entrance of said pre-treatment furnaces and downstream of said nozzles;

tension control roll means comprising bridle rolls having driving motors for driving them, said bridle rolls being disposed downstream of said pre-treatment furnaces and upstream of said dipping bath for controlling the tension in said pre-treatment furnaces separately from the tension between said bridle rolls and said tension rolls downstream of said nozzles, said bridle rolls having shafts and bearings for said shafts and sealing boxes around said bearings;

a housing around said bridle rolls in communication with said pre-treatment furnace, the shafts of said bridle rolls extending through the opposite sides of said housing, said sealing boxes being on said housing covering the points at which said shafts extend through said housing, water jackets on said housing at said points, said bearings for each shaft being on said water jackets with said water jacket between said bearing and said housing, said bearings each having seal means for sealing the passage between said shaft and said housing, each shaft extending through one of said sealing boxes to the corresponding driving motor, and seal means between each shaft and said one sealing box for sealing the passage between said shafts and said sealing box; and means for supplying an inert gas to said sealing boxes.

* * * * *